United States Patent [19]

Fujimatsu et al.

[11] 4,304,844

[45] Dec. 8, 1981

[54] METHOD FOR FORMING A CYAN DYE IMAGE

[76] Inventors: Wataru Fujimatsu; Yasushi Usagawa; Osamu Sasaki; Katsumi Matsuura, all of 1, Sakura-machi, Hino-shi, Tokyo, Japan

[21] Appl. No.: 145,685

[22] Filed: May 1, 1980

[30] Foreign Application Priority Data

May 7, 1979 [JP] Japan ..... 54-55379

[51] Int. Cl.[3] ..... G03C 7/00

[52] U.S. Cl. ..... 430/384; 430/385; 430/552; 430/553; 430/558

[58] Field of Search ..... 430/384, 385, 552, 553, 430/558

[56] References Cited

U.S. PATENT DOCUMENTS

| | | | |
|---|---|---|---|
| 2,536,010 | 12/1950 | Schmidt et al. | 430/552 |
| 2,569,906 | 10/1951 | Starke | 430/386 |
| 2,772,162 | 11/1956 | Salminen et al. | 430/384 |
| 3,880,661 | 4/1975 | Lau et al. | 430/553 |
| 4,124,396 | 11/1978 | Osborn | 430/553 |

*Primary Examiner*—J. Travis Brown

[57] ABSTRACT

A method for forming a cyan dye image by developing an exposed silver halide photographic material with a developer containing a color developing agent in the presence of a cyan coupler, wherein the coupler is a 2,5-diacylaminophenol in which each acylamino group has a substituent containing an oxycarbonyl, sulfonyloxy, oxysulfonyl, arylsulfonamide or arylsulfamoyl group or other organic group containing a sulfone group.

17 Claims, No Drawings

METHOD FOR FORMING A CYAN DYE IMAGE

This application claims the priority of Japanese Application No. 55379/1979, filed May 7, 1979.

The present invention relates to a cyan coupler and a method to form a cyan dye image, particularly to the method to form a cyan dye image by means of color developing a silver halide color photographic sensitive material in the presence of 2,5-diacyl amino type cyan coupler.

As for the fundamental natures required for a coupler, it is desired to have various characteristics such as not only simple color dye forming, but high dissolubility into an organic solvent having a high boiling point or to alkali, and satisfactory dispersibility and stability in silver halide photographic emulsion, and durability against light, heat, moisture etc, favorable spectral absorption characteristics, clear transparency, high color density and further sharpness of a dye image to be obtained thereby. Above all, it is required the improvements of image preservability such as heat resistance, moisture resistance, light resistance etc., in cyan coupler.

Further, it becomes a serious issue from the viewpoint of the recent antipollution measures to remove benzyl alcohol which is to be added in a color developer. However, if a color developer containing no benzyl alcohol brings about such a disadvantage that the color developability of a coupler added into silver halide photographic emulsion, (e.g. the color dye forming speed and the maximum color density thereof,) is generally lowered. And the above disadvantage is remarkable in cyan coupler. Therefore, it is now earnestly desired that the color developability of cyan coupler does not depend upon benzyl alcohol, and the studies for improvement thereof are being carried out along with the improvements of the said image preservability. However, so far as the present inventor knows of the cyan couplers which have so far been known, it is not yet found any coupler which satisfy all of the properties required as above.

That is, the following cyan couplers having so far been known are given. For example, the following coupler as described in the U.S. Pat. No. 2,801,171;

6-[α-(2,4-di-tert-amylphenoxy)butaneamide]-2,4-dichloro-3-methylphenol is, as is obvious from the underdescribed examples, excellent in light resistance, but has a defect in heat resistance, and in addition, the color development thereof is largely dependent upon benzyl alcohol and the maximum color density thereof is insufficient in the color developing solution out of which benzyl alcohol is removed.

And, the coupler as described in the Japanese Patent Laid-Open-to-Public publication No. 53-109630 is the one that dicarbonylamino group is substituted to the 2 and 5 positions of phenol, and the dispersion stability at the time of coating or finishing thereof has been improved by that the end of the substituent at the 5 position inducts p-alkylsulfonylaminophenoxy group or p-alkylaminosulfonylphenoxy group, that is described therein, but, as is obvious from the examples described hereunder, the developability of the said coupler is still dependent largely upon benzyl alcohol, therefore it is desirable to improve the above point.

Further, as described in the U.S. Pat. No. 3,839,044, Japanese Patent Publication No. 48-36894, the Japanese Patent L-O-P publication Nos. 47-37425, 50-130441, 50-108841, 50-120334, etc., and as is obvious from the examples described hereunder, the phenol type cyan couplers do not satisfy the required properties thereof, because the problems remain in the heat resistance thereof, or the color dye forming speed and the maximum color density are insufficient in color developer containing no benzyl alcohol.

The first object of the invention is to provide a cyan coupler having the desirable properties requested for the cyan coupler as above described. The second object of the invention is to provide a cyan coupler having the high dissolubility in alkali or organic solvent having a high boiling point and the superb dispersiveness and stability in silver halide color photographic emulsion. The third object of the invention is to provide an image forming method of cyan coupler of which image preservability, i.e., heat resistance, light resistance and antihumidity, are superior, and also color dye forming speed thereof in color developing solution out of which benzyl alcohol is removed is faster, and further it gives a cyan dye image having a high color density.

We found new cyan couplers, which are 2,5-diacylaminophenol having at least one of such a group that the each of substituents of the phenol ring at the 2 and 5-positions is chosen from an oxycarbonyl, sulfonyloxy, oxysulfonyl, arylsulfonamide, arylsulfamoyl group or another organic group having at least one sulfone group.

The cyan coupler as described in the present claims (hereinafter referred to as Coupler of the Invention) is preferably shown in the following formula;

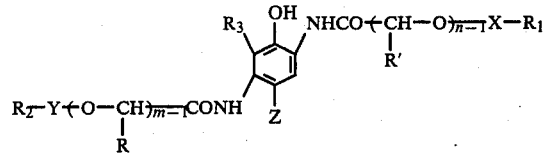

wherein, R and R′ each represent a hydrogen atom or an alkyl group having 1 to 20 carbon atoms; $R_1$ and $R_2$ each represent a hydrogen atom, an oxycarbonyl, sulfonyloxy, oxysulfonyl, arylsulfonamide, arylsulfamoyl group, or an univalent organic group having at least one sulfone group; $R_3$ represents a hydrogen or halogen atom; X and Y each represent an alkylene or arylene group; Z represents a hydrogen atom or a split-off radical; and n and m each have a value of an integer of 1 or 2; provided that $R_1$ and $R_2$ are not hydrogen atoms simultaneously.)

Further, $R_1$ and $R_2$ each may be substituted by aliphatic hydrocarbon or a group which is selected from an aryl or 5 or 6-membered heterocyclic ring containing a nitrogen, oxygen or sulfur atom, and as for the aliphatic hydrocarbon, either one of the saturated as well as either one of the straight chained, the branched or the ring-formed may be used. And preferably, they are alkyl groups (e.g., methyl, ethyl, isobutyl, dodecyl, octadecyl, cyclobutyl or cyclohexyl) and alkenyl groups (e.g., allyl group). As for the aryl group, a phenyl group, naphthyl groups are given as the examples, and as for the heterocyclic ring, pyridinyl, quinolyl, thienyl, piperidyl, imidazolyl, etc., are the typical examples. And as for the substituents which are to be introduced into the above-mentioned aliphatic hydrocarbon, aryl, and heterocyclic ring group, the following examples are given such as a halogen atom, a nitro, hydroxy, carboxyl, amino, substituted amino, sulfo, alkyl, alkenyl, aryl, heterocyclic ring, alkoxy, aryloxy, arylthio, arylazo, acylamino, carbamoyl, ester, acyl, acyloxy, sulfonamide, sulfamoyl, sulfonyl or morpholino group.

Furthermore preferable $R_1$ and $R_2$ are each an oxycarbonyl, oxysulfonyl or sulfonyloxy group.

And in the above formula, for the X and Y as for the preferable examples of the alkylene group are given such as a methylene, ethylene or ter-butylene group, and the example of arylene group is a phenylene or naphthalene group, and further in each of the above groups, the following groups may also be introduced as a substituent; a halogen atom (e.g., chlorine, bromine, fluorine), an alkyl (e.g., methyl, ethyl, isobutyl, dodecyl, ter-amyl, cyclohexyl, pentadecyl group), nitro, hydroxy, carboxyl, amino, sulfo, 5 or 6-membered heterocyclic, alkoxy, aryloxy, arylthio, acylamino, carbamoyl, ester, acyl, acyloxy, sulfonamide, sulfamoyl, sulfonyl, monopholino group, etc.

And, R and R' represent a hydrogen atom or an alkyl group having 1 to 20 carbon atom and the concrete examples of the said alkyl group includes a methyl, ethyl, butyl, dodecyl group, etc. The preferable X and Y each are arylene groups.

A concrete example of the coupling split-off radical for Z includes a halogen atom (e.g., chlorine, bromine, or fluorine), and an aryloxy, carbamoyloxy, carbonylmethoxy, acyloxy, alkyloxy, sulfonamide, succinimide group, in which oxygen or nitrogen atom is directly bonded at the active point thereof. And a concrete example the useful coupling split-off groups are such as described in the U.S. Pat. No. 3,471,563, the Japanese Patent L-O-P publication Nos. 47-37425, 50-10135, 50-117422, 50-130441, 51-108841, 50-120334, 52-18315, 53-52423, 53-105226 and Japanese Patent Publication No. 48-36894.

The Coupler of the Invention is characterized that it has acylamino group each at the 2 and 5-positions of the phenol, and that the said group has the groups like $R_1$ and $R_2$ in the formula, and it may be proved that various satisfactory characteristics thereof can be obtained by introducing the said group therein.

Next, the preferable examples of the Coupler of the Invention are given hereunder.

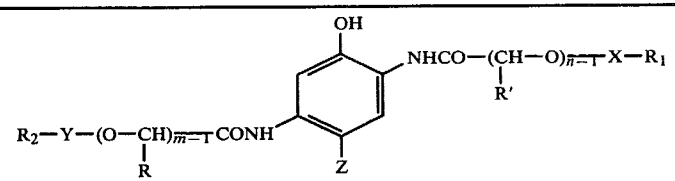
| No | $R_1$ | $R_2$ | X | Y | n | m | R | R' | Z |
|---|---|---|---|---|---|---|---|---|---|
| 1 | H | $CH_3OCO-$ | 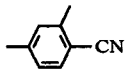 | 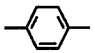 | 1 | 2 | $-C_2H_5$ | — | H |
| 2 | H | $CH_3OCO-$ | $-C_4H_8-$ | 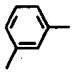 | 1 | 2 | $-C_2H_5$ | — | H |
| 3 | H | 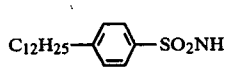 | 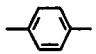 | 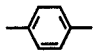 | 1 | 2 | $-C_2H_5$ | — | H |
| 4 | H | 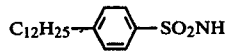 | 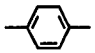 | 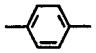 | 1 | 2 | $-C_2H_5$ | — | 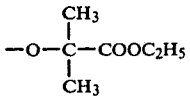 |
| 5 | 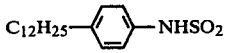 | H | 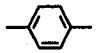 | 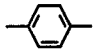 | 2 | 1 | — | $C_2H_5$ | H |
| 6 | $C_{12}H_{25}-SO_2-$ | H | 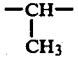 | 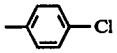 | 1 | 1 | — | — | Cl |
| 7 | H | $C_{12}H_{25}OO_2S-$ | 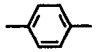 | 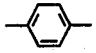 | 1 | 2 | $C_4H_9$ | — | H |
| 8 | H | 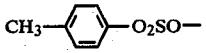 | 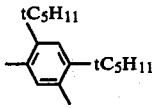 | 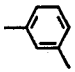 | 2 | 2 | $C_4H_9$ | H | H |
| 9 | H | $C_2H_5OOC-$ | 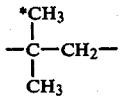 | 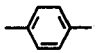 | 1 | 2 | $C_4H_9$ | — | 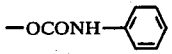 |

-continued
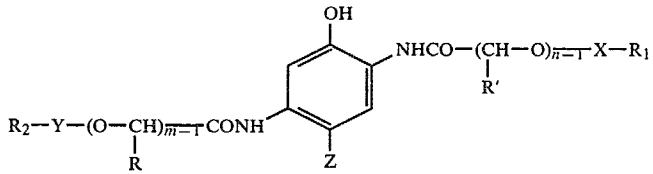
| No | $R_1$ | $R_2$ | X | Y | n | m | R | R' | Z |
|---|---|---|---|---|---|---|---|---|---|
| 10 | H | $C_{12}H_{25}$— 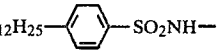 —$SO_2NH$— | 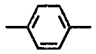 | 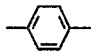 | 1 | 2 | $C_4H_9$ | — | —$OCH_2COOCH_3$ |
| 11 | H | $C_{12}H_{25}$— 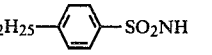 —$SO_2NH$ | 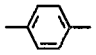 | 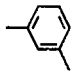 | 1 | 2 | $C_4H_9$ | — | —$OCH_2CONH(CH_2)_2OC_2H_5$ |
| 12 | H | 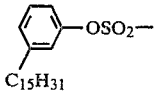 | 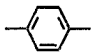 | 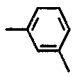 | 1 | 2 | $C_4H_9$ | — | —OCH(CH$_3$)—$COOC_2H_5$ |
| 13 | H | $C_{12}H_{25}OCO$— | —*C(CH$_3$)$_2$—$CH_2$— | 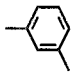 | 1 | 2 | $C_2H_5$ | — | H |
| 14 | H | $C_{12}H_{25}SO_2$—CH(CH$_3$)CONH— | 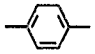 | 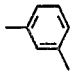 | 1 | 2 | $C_2H_5$ | — | H |
| 15 | 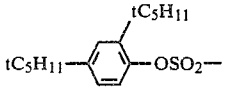 | $CH_3$— 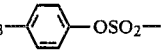 —$OSO_2$— | 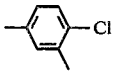 | 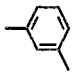 | 2 | 2 | $C_2H_5$ | —$C_2H_5$ | —O— 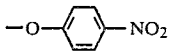 —$NO_2$ |
| 16 | $C_2H_5OOC$— | $C_{14}H_{29}OOC$— | 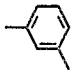 | 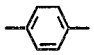 | 2 | 2 | $C_2H_5$ | H | 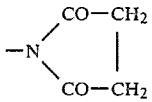 |
| 17 | —H | $C_{16}H_{33}SO_2O$— | 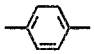 | 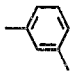 | 1 | 2 | —$C_4H_9$ | — | H |

-continued

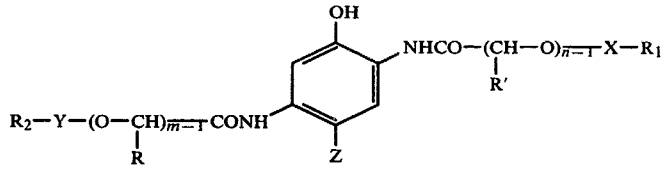

| No | $R_1$ | $R_2$ | X | Y | n | m | R | R′ | Z |
|---|---|---|---|---|---|---|---|---|---|
| 18 | $C_{12}H_{25}$—⟨benzene⟩—$SO_2NH$— | —H | —⟨benzene⟩— | —⟨benzene⟩— | 2 | 1 | — | —$C_2H_5$ | —O—CH(CH$_3$)—$COOCH_3$ |
| 19 | $C_{16}H_{33}SO_2O$ | —H | —⟨benzene⟩ | *—$CH_2$—C(CH$_3$)$_2$— | 2 | 1 | — | H | —O—CH(CH$_3$)—COOH |
| 20 | —H | $CH_3OOC$— | *CH$_3$ —C(CH$_3$)—$CH_2$— | —⟨benzene⟩— | 1 | 2 | —H | — | —O—CH($CH_2COOH$)—COOH |
| 21 | —H | $C_{12}H_{25}$—⟨benzene⟩—$NHSO_2$— | *CH$_3$ —C(CH$_3$)—$CH_2$— | —⟨benzene⟩— | 1 | 2 | —$C_2H_5$ | — | —OCONH—⟨benzene⟩ |
| 22 | —H | $C_{16}H_{33}OO_2S$— | Cl —⟨benzene⟩— | —⟨benzene⟩— | 1 | 2 | —$C_4H_9$ | — | —$OSO_2$—⟨benzene⟩ |
| 23 | —H | $C_2H_5OO_2S$— | —⟨benzene⟩— | —⟨benzene⟩— | 1 | 2 | —$C_{12}H_{25}$ | — | —O—CH(CH$_3$)—CONH$(CH_2)_2OCH_3$ |
| 24 | —H | $C_{12}H_{25}SO_2O$— | —⟨benzene⟩— | —⟨benzene⟩ | 1 | 2 | —$C_4H_9$ | — | —$OCOOC_2H_5$ |
| 25 | —H | $CH_3$—⟨benzene⟩—$SO_2O$— | $tC_5H_{11}$ ⟨benzene⟩ $tC_5H_{11}$ | ⟨benzene⟩ | 2 | 2 | —H | —$C_2H_5$ | H |

-continued
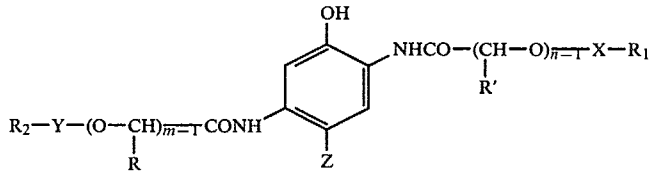
| No | $R_1$ | $R_2$ | X | Y | n | m | R | R' | Z |
|---|---|---|---|---|---|---|---|---|---|
| 26 | —H | 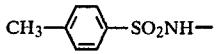 | 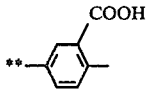 | 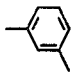 | 1 | 2 | $-C_2H_5$ | — | 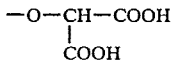 |
| 27 | $C_2H_5OOC$ | —H | 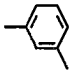 | 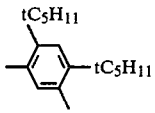 | 1 | 2 | $-C_2H_5$ | — | H |
| 28 | —H | 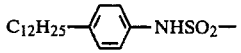 | 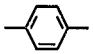 | 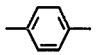 | 1 | 2 | $-C_2H_5$ | — | 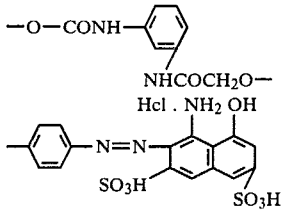 |
| 29 | —H | 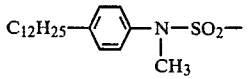 | 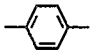 | 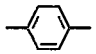 | 1 | 2 | $-C_2H_5$ | $-C_2H_5$ | H |
*: Tertiary carbon couplers to carbon of carbonyl.
**: Meta position of carboxylic acid couplers to carbonyl carbon.

The synthesis examples of the Coupler of the Invention are shown as follows:

Synthesis example 1 (Synthesis of the example coupler 3)

A. Synthesization of Intermediate 2-benzamide-5-nitrophenol

A dissolution is made by 42.0 g of 2-amino-5-nitrophenol and 33.3 g of triethylamine together in 1,000 ml of acetonitrile, and then a solution of 40.8 g of benzoyl chloride and 100 ml of acetonitrile is dropped therein for an hour with refluxing and stirring. After completed the dropping, the refluxing and stirring is continued for six hours and then triethylamine hydrochloride deposited therefrom is filtered to separate and the filterate thereof is condensed and dried to solidify and the residue thereof is recrystallized in ethylalcohol to obtain a light yellowish object.

Melting point at 282°-285° C.

Yield: 64.4 g.

Values of elementary analysis in percents

| | C | H | N |
|---|---|---|---|
| Theoretical values | 60.46 | 3.90 | 10.85 |
| Analytical values | 60.44 | 3.91 | 10.83 |

B. Synthesization of 2-benzamide-5-{α-[4-(4-dodecylphenylsulfonamide)-phenoxy]butanamide}phenol 51.6 g of 2-benzamide-5-nitrophenol is conducted hydrogenerating reaction for seven hours at normal temperature and pressure in tetrahydrofurane by making use of 1 g of Pd/C as a catalizer. Next, Pd/C was filtered to separate promptly and the reactant solution therefrom is condensed and then dissolved in the solution of 1000 ml of $CH_3CN$ and 22.2 g of triethylamine. A solution of 114.9 g of α-[4-(4-dodecylphenylsulfonamide)phenoxy]butanic acid chloride and 200 ml of $CH_3CN$ is dropped in the said solution with refluxing and stirring for 1.5 hours. After the dropping, the refluxing is continued for seven hours and then triethylene hydrochloride deposited therefrom is filtered to separate and the filterate is condensed and dry-solidified and the resulted matter is crystallized in hexane to obtain a white solid.

Melting point at 109°-112° C.

Yield: 100.4 g.

Values of elementary analysis in percents

| | C | H | N | S |
|---|---|---|---|---|
| Theoretical values | 68.97 | 7.20 | 5.89 | 4.49 |
| Analytical values | 70.01 | 7.21 | 5.92 | 4.43 |

Synthesis example 2 (Synthesis of the example coupler 3)

C. Synthesization of Intermediate 2-(2,2-dimethylpropaneamide)-5-nitrophenol.

For obtaining a solid matter, 63.1 g of 2-amino-5-nitrophenol, 50.0 g of triethylamine and 54.3g of 2,2-dimethyl propanic acid chloride are used by conducting the similar treatment to that of the synthesis example 1-A and the said solid obtained is purified to obtain a yellowish object.

Melting point at 300° C. or higher.

Yield: 89.2 g.

Value of elementary analysis of in percents

| | C | H | N |
|---|---|---|---|
| Theoretical values | 55.45 | 5.92 | 11.76 |
| Analytical values | 55.48 | 5.91 | 11.69 |

D. Synthesization of 2-(2,2-dimethylpropanamido)-5-[α-(3-dodecyloxycarbonylphenoxy)butanamide]phenol 71.5 g of 2-(2,2-dimethylpropanamide)-5-nitrophenol is conducted hydrogenerating reaction by making use of 1.5 g of Pd/C, for 10 hours at the normal temperature and pressure. Next, Pd/C is filtered to separate promptly and the filtrate thereof is condensed, of which the residue is dissolved in a solution of 1,000 ml of $CH_3CN$ and 22.2 g of triethylamine, and 90.4 g of α-[3-(dodecyloxycarbonyl)phenoxy]butanic acid chloride is used by conducting the similar treatment to that of the synthesis example 1-B, and the obtained solid matter is purified by making use of the mixed solvent of ligloin alcohol to obtain a white solid.

Melting point at 124°-127° C.

Yield: 80.8 g.

Values of elementary analysis in percents

| | C | H | N |
|---|---|---|---|
| Theoretical values | 70.07 | 8.65 | 4.81 |
| Analytical values | 70.11 | 8.65 | 4.79 |

Synthesis example 3 (the example coupler 19)

In a solution of 1000 ml of $CH_3CN$ and 33.3 g of triethylamine, 88.9 g of 2-amino-4-(α-carboxyethoxy)-5-(2,2-dimethylpropanamide) (which is to be prepared according to the preparation process as described in the Japanese Patent L-O-P Publication No. 52-153923) is dissolved therein, and then 156.8 g of 3-(hexadecylsulfonyloxy)phenoxyacetyl chloride is dropped therein for two hours with heating, refluxing and stirring. After completed the dropping, the reaction is further conducted for five hours with refluxing and stirring, and triethylamine hydrochloride deposited therefrom is filtered to separate and then the filtrate thereof is evaporated to dry and the residue thereof is crystallized by making use of n-Hexane, and then a white solid matter is obtained.

Melting point at 101°-104° C.

Yield: 170.4 g.

Values of elementary analysis in percents

| | C | H | N | S |
|---|---|---|---|---|
| Theoretical values | 62.10 | 7.95 | 3.81 | 4.36 |
| Analytical values | 62.14 | 7.93 | 3.79 | 4.39 |

Among the Coupler of the Invention, the oil-soluble and alkali-soluble couplers are included in. Oil-soluble couplers among the above can be dispersed and contained into a silver halide emulsion after dissolving the couplers into an organic solvents, etc., having high boiling points in a so-called oil-protect-dispersion method. And, the couplers having alkaline solubility can be dispersed and contained in a silver halide emulsion in Fisher's method of dispersion, and as for the couplers of this type, the example coupler [28] can be given as an example thereof.

The Couplers of the Invention, for instance, an oil-protect type coupler can be contained in silver halide emulsion in such method that has so far been known. For example, one or more of the Coupler of the Invention are dissolved in a single solution of the organic solvent having the high boiling point at 175° C. or higher such as tricresylphosphate, dibutylphthalate, or the solvent having a low boiling point such as butyl acetate, butyl propionate, or in the mixed solution thereof as occasion demands, and then they are mixed in gelatin solution containing surface active agent, and next, the mixture thereof is emulsified by a high speed mixer or colloid mill, and then silver halide is added therein. The result emulsion is coated on a photographic support to obtain a color photographic material.

And, the coupler which is to be added in a color developer, that is, so-called coupler-in-developer, have the advantage because it is easier to add the couplers into a color developer. As a result of the above properties thereof, if the Coupler of the Invention is contained in a photographic sensitive layer of a photographic sensitized material like the so-called coupler-in-emulsion type coupler, etc., the said photographic sensitized material has the advantages that the photographic sensitive layer thereof can be thinned, sharpness of an obtained image is improved, and further harmful interaction is not shown in color development, and particularly color stain and so on are improved owing to the good reactivity thereof.

Coupler of this Invention is applicable to diffusion transfer method, and the examples of the couplers most suitable are an illustrated coupler [28] and the like. And when Coupler of this Invention is added to emulsion of silver halide of this invention, Coupler of this Invention with the range of about 0.07–0.7 mol and preferable range of 0.1–0.4 mol is added to 1 mol of silver halide normally.

Any silver halide used for silver halide emulsion of this invention, whose example includes such as silver bromide, silver chloride, silver iodobromide, silver chlorobromide and silver chloroiodobromide etc.

Silver halide emulsion can be prepared by a well-known manufacturing process.

Silver halide emulsion used in this invention can be chemically sensitized by a single use or a combined use of a sulfur sensitizer such as allylthiacarbamide, thiourea and cystine, a selenium sensitizer, a reduction sensitizer such as stannous salt and polyamine, a noble metal sensitizer such as gold sensitizer such as potassium aurithiocyanate, potassium chloroaurate, 2-aurosulfobenzthiazolemethylchloride, or water-soluble salt of ruthenium, rhodium or iridium actually ammoniumchloropalladate, potassiumchloroplatinate and sodiumchloropalladite.

Silver halide of this invention can be given a spectral sensitization by the selection of proper sensitizing dye in order to give sensitivity to light-sensitive wavelength range that is necessary for red-sensitive emulsion.

Futher, silver halide emulsion of this invention can contain known photographic additives of various kinds.

The color developer used for the invention is the one of which principal component is a color developing agent of aromatic primary amines. As for the concrete examples of the above color developing agents, the ones of p-phenylenediamines are outstanding, e.g., the following are given; diethyl-p-phenylenediamine hydrochloride and monomethyl-p-phenylenediamine hydrochloride, dimethyl-p-phenylenediamine hydrochloride, 2-amino-5-diethylaminotoluene hydrochloride, 2-amino-5-(N-ethyl-N-dodecylamino)-toluene, 2-amino-5-(N-ethylN-β-methanesulfonamide ethyl)aminotoluene hydrochloride, 4-(N-ethyl-N-β-methansulfonamide ethylamino)aniline, 4-(N-ethyl-N-β-hydroxyethylamino)aniline, 2-amino-5-(N-ethyl-N-β-methoxyethyl)aminotoluene, etc.

And such color developing agent can be used independently or with combined use of more than two kinds or jointly with black and white developing agent such as hydroquinone etc. in case of need. Further, color developer generally contains alkaline agent such as sodium hydroxide, ammonium hydroxide, sodium carbonate, sodium sulfate and sodium sulfite etc. and may further contain various kinds of additives such as alkali matal halide like potassium bromide or development regulating agent such as citradin acid.

In the color development method used for this invention, after an exposure is given to the light-sensitive material, the color development is made in an ordinary coupler-in-emulsion type color development method. This color developer is exceptionally contained in a photograhic material, for example, in the image-receiving material in the diffusion transfer method.

As color developer for the use of the aforesaid coupler-in-emulsion type color, the one with the following composition is given as a typical one, for example.

| | |
|---|---|
| [color developer composition] | |
| 4-amino-3-methyl-N-ethyl-N-(β-methanesulfoneamidoethyl) anilinesulfate | 5.0 g |
| Sodium sulfite (anhydride) | 2.0 g |
| Sodium carbonate (monohydrate) | 50 g |
| Potassium bromide | 1.0 g |
| Potassium hydroxide | 0.55 g |
| Add water to make 1 l. | |

The coupler of this invention contained in the color emulsion of this invention reacts with a product oxidized form of color developing agent produced when silver halide is developed with such color developer and forms a cyan dye.

After such color development, the proper combination of each process selected from usual photographic processes, for example, the processes with the processing liquid such as the stopping, the stop-fixing, the fixing, the bleach-fixing, the stabilizing, washing and drying processes.

Next, the typical example of color developing process step applied to coupler-in-emulsion type color negative light-sensitive material, will be shown.

| Process step (33° C.) | Process time |
|---|---|
| Color developing | 3' 15" |
| Bleaching | 6' 30" |
| Washing | 3' 15" |
| Fixing | 6' 30" |
| Washing | 3' 15" |
| Stabilizing | 1' 30" |

Composition of each processor that can be used in the aforesaid process step is as follows, for example.

| | |
|---|---|
| [Color developer] | |
| 4-amino-3-methyl-N-ethyl-N-(β-hydroxyethyl)aniline sulfate | 4.8 g |
| Sodium sulfite anhydride | 0.14 g |
| Hydroxyamine ½ sulfate | 1.98 g |
| Sulfuric acid | 0.74 mg |
| Potassium carbonate anhydride | 28.85 g |
| Potassium bicarbonate anhydride | 3.46 g |
| Potassium sulfite anhydride | 5.10 g |
| Potassium bromide | 1.16 g |
| Sodium chloride | 0.14 g |
| 3 sodium salt nitrilo acetic acid (monohydrate) | 1.20 g |
| Potassium hydroxide | 1.48 g |
| Add water to make 1 l | |
| [Bleacher] | |
| Ethylenediaminetetra acetic acid iron ammonium salt | 100 g |
| Ethylenediaminetetra acetic acid 2 ammonium salt | 10 g |
| Ammonium bromide | 150 g |
| Glacial acetic acid | 10 mg |
| Add water to make 1 l and use aqueous ammonia to adjust to pH 6.0. | |
| [Fixer] | |
| Ammonia thiosulfate | 175.0 g |
| Sodium sulfite anhydride | 8.6 g |
| Sodium metasulfite | 2.3 g |
| Add water to make 1 l and use acetic acid to adjust to pH 6.0. | |
| [Stabilizer] | |
| Formalin (37% water solution) | 1.5 ml |
| Koniducks (made by Konishiroku Photo Ind. Co., Ltd.) | 7.5 ml |
| Add water to make 1 l | |

Next, another example for the color paper will be given.

| [Process step] Process step (30° C.) | Process time |
|---|---|
| Color developing | 3' 30" |
| Bleach-fixing | 1' 30" |
| Washing | 2' |
| Stabilizing | 1' |

Composition of each processing liquid that can be used in the aforesaid process step is as follows, for example.

| | |
|---|---|
| [Color developer (1)] | |
| 4-amino-3-methyl-N-ethyl-N-(β-methanesulfoneamidoethyl) aniline sulfate | 5.0 g |
| Hexametaphosphoric acid | 2.5 g |
| Sodium sulfite anhydride | 1.85 g |
| Sodium bromide | 1.4 g |
| Potassium bromide | 0.5 g |
| Borax | 39.1 g |

The aforesaid color developer (1) is a color developer containing no benzyl alcohol, and color developer (2) is an color developer containing benzyl alcohol. In case this invention is used for processing of coupler in-emulsion type color positive light-sensitive material, both type of color developer (1) and color developer (2) mentioned above can be used and the use of the aforesaid color developer (1) is desirable from the viewpoint of environmental pollution prevention in particular and in this invention, satisfactory photographic characteristic is obtained when this desirable color developer (1) is used.

| | |
|---|---|
| [Bleach-fixer] | |
| Ethylenediaminetetraacetic acid iron ammonium salt | 61.0 g |
| Ethylenediaminetetraacetic acid 2 ammonium salt | 5.0 g |
| Ammonium thiosulfate | 124.5 g |
| Sodium metabisulfite | 13.3 g |
| Sodium sulfite anhydride | 2.7 g |
| Add water to make 1 l | |
| [Stabilizer] | |
| Glacial acetic acid | 20 ml |
| Add water to make 1 l and use sodium acetate to adjust to pH 3.5–4.0. | |

This invention will be explained concretely as follows with the aid of examples.

EXAMPLE (1)

10 g of each Coupler of this Invention shown in table 1 and comparison couplers [A], [B] and [C] are added to the mixture liquid of 2.5 ml of dibutylphthalate and 20 ml of ethyl acetate respectively and they are warmed to 60° C. and dissolved. Each solution is mixed with 5 ml of 10% water solution of alkanol B (alkylnaphthalenesulfonate, product of Du-Pont) and 200 ml of 5% water solution of gelatin and the mixture is emulsified by a colloid mill and dispersed. Then this coupler dispersion liquid is added to 500 g of gelatin-silver chlorobromide (containing silver bromide of 20 mol%) emulsion and it is coated onto polyethylene coated paper and dried and 6 kinds of silver halide color photographic materials (sample number [1]–[6]). After an exposure through a wedge in a usual method, color development is made thereon in accordance with the color developing process step for the color paper above-mentioned cyan color images are obtained. As for the color developer, 2 kinds of composition liquid e.g., the one with benzyl alcohol added [aforesaid color developer (2)] and the other without benzyl alcohol added [aforesaid color developer (1)] were used. For each sample obtained, photographic characteristics are measured. The results of the measurement are shown in table 1.

TABLE 1

| Sample No. | Coupler used | With benzyl alcohol added: Sensitivity | With benzyl alcohol added: Maximum density (Dmax) | Without benzyl alcohol added: Sensitivity | Without benzyl alcohol added: Maximum density (Dmax) | Maximum absorption wave length (mμ) |
|---|---|---|---|---|---|---|
| 1 | Illustrated coupler - 4 | 100 | 2.20 | 80 | 2.05 | 663 |
| 2 | Illustrated coupler - 12 | 100 | 2.20 | 83 | 2.21 | 670 |

TABLE 1-continued

| Sample No. | Coupler used | With benzyl alcohol added: Sensitivity | With benzyl alcohol added: Maximum density (Dmax) | Without benzyl alcohol added: Sensitivity | Without benzyl alcohol added: Maximum density (Dmax) | Maximum absorption wave length (mμ) |
|---|---|---|---|---|---|---|
| 3 | Illustrated coupler - 19 | 100 | 2.20 | 84 | 2.20 | 645 |
| 4 | Comparison coupler - A | 100 | 2.20 | 55 | 1.52 | 655 |
| 5 | Comparison coupler - B | 95 | 1.91 | 60 | 1.55 | 664 |
| 6 | Comparison coupler - C | 100 | 1.81 | 50 | 1.54 | 655 |

In the table, the figures for sensitivity are the relative values against "100" that represents the sensitivity of sample (4) containing comparison coupler [A] which is processed with a developer containing benzyl alcohol. Comparison couplers [A], [B] and [C] are as follows.

Comparison coupler [A]

6-[α-(2,4-di-tert-amylphenoxy)butaneamidel]-2,4-dichloro-3-methylphenol (the one described in the aforesaid U.S. Pat. No. 2,801,171)

Comparison coupler [B]

2-benzamide-5-[α-(4-butylsulfonylaminophenoxy)tetradecaneamide]phenol (the one described in the aforesaid Japanese Patent L-O-P publication No. 53-109630)

Comparison coupler [C]

6-[α-(2,4-di-n-amylphenoxy)butaneamide]-2-chloro-3-methyl-4-(1-phenyl-5-tetrazolyloxy)phenol (the one described in the aforesaid U.S. Pat. No. 3,839,044)

As is clear from the above-mentioned table 1, desirable spectral absorption characteristics and the higher maximum density of a color image is obtained than any one of comparison couplers [A], [B] and [C] even when a color developer containing no benzyl alcohol is used.

EXAMPLE (2)

In a similar manner to the aforesaid example (1), samples 7–12 of 6 kinds of photographic materials are obtained and stabilities against light, heat and humidity are examined. The results are shown in table 2.

TABLE 2

| Sample No. | Coupler used | With benzyl alcohol added: Stabilities against Light | Heat | Humidity | Without benzyl alcohol added: 38 Stabilities against Light | Heat | Humidity |
|---|---|---|---|---|---|---|---|
| 7 | Illustrated coupler - 3 | 80 | 100 | 98 | 81 | 100 | 98 |
| 8 | Illustrated coupler - 7 | 92 | 100 | 100 | 91 | 100 | 100 |
| 9 | Illustrated coupler - 16 | 91 | 100 | 100 | 92 | 100 | 100 |
| 10 | Comparison coupler - A | 91 | 65 | 73 | 90 | 64 | 72 |
| 11 | Comparison coupler - B | 72 | 100 | 98 | 71 | 100 | 97 |
| 12 | Comparison coupler - C | 91 | 65 | 72 | 90 | 65 | 71 |

In the table, the figures for light stability represent a remaining ratio of color density after each image obtained is exposed by xenon fade meter for 200 hours to the density assuming 100 before the exposure. The figures for humidity stability represent the remaining ratio of color density after the preservation for two weeks under the conditions of 50° C. and relative humidity of 80% to 100 that is the density before the test. The figures for heat stability represent the remaining ratio of color density after the preservation for two weeks under the condition of 77° C. to 100° that is the density before the test.

As is clear from table 2, comparison couplers [A] and [C] have an excellent property in light stability but they are problematic in heat stability. Comparison coupler [B], on the other hand, is a coupler having heat stability which is more improved than that of comparison coupler [A] and [B] but is problematic in light stability when processed with a developer without benzyl alcohol added.

On the other hand, in the illustrated couplers [3], [7] and [16], an effect of the improvement is recognized on the point of light stability even compared with the aforesaid comparison coupler [B].

EXAMPLE (3)

The aforesaid illustrated coupler [24] of this invention and the aforesaid comparison coupler [A] in the amount of 10 g are each added to the mixed liquid of 25 ml of dibutylphthalate and 20 ml of ethylacetate and they are warmed to 60° C. to be dissolved. Each solution is mixed with 5 ml of 10% water solution of alkanol B and 200 ml of 5% water solution of gelatin and the mixture is emulsified by a colloid mill, and dispersion liquid or coupler is prepared. Then this dispersion liquid is added to 500 g of the negative emulsion of high sensitive gelatin silver iodobromide (containing 6.0 mol% of silver iodide) and it is coated onto the celluloseacetate film base and dried and samples 13 and 14. After an exposure in a similar manner to the example 1, color development is made in accordance with the aforesaid color developing process step for the use of coupler-in-emulsion type color negative.

Photographic characteristics are measured on the cyan color images and the results thereof are shown in table 3.

TABLE 3

| Sample No. | Coupler used | Relative sensitivity | Maximum density (Dmax) | Maximum absorption wavelength (μmax) |
|---|---|---|---|---|
| 13 | Illustrated coupler - 24 | 100 | 2.50 | 658 |
| 14 | Comparison coupler - A | 54 | 1.54 | 660 |

As is clear from table 3, it is brought to light that the sample in which the coupler of this invention is used has a high maximum density. And the sample related to this invention had cyan negative color images that are excellent in the transparency.

EXAMPLE (4)

The aforesaid illustrated coupler [28] that is the Coupler of this Invention is added to the emulsion of high sensitive silver iodobromide for the use of an ordinary negative (containing 5 mol% of silver iodide) by Fischer's dispersion method (0.2 mol amount is used for each 1 mol of silver halide) and this emulsion is coated onto the triacetate film base by an ordinary method and dried.

After an exposure in a similar manner to example (1), they are processed for 3 minutes at 24° C. with an alkaline developer used that has a following composition.

| [Developer composition] | |
|---|---|
| Sodium sulfite | 20 g |
| 4-N-ethyl-N-β-hydroxyethyl-aminoaniline | 11.0 g |
| Add water to make 1 l | |

When this development is made, the image receiving layer of the image receiving material having the image receiving layer that contains dimethyl-β-hydroxyethyl-γ-stearoamido-propylammonium-hydrogenphosphate on polyethylene coated paper, is contacted with the light-sensitive layer of the aforesaid samples and the image receiving material is peeled off after the development. Thereupon, on the image receiving material, a clear cyan positive image with a high maximum density and with an excellent photographic characteristic, is obtained similarly to the aforesaid examples (1), (2) and (3).

EXAMPLE (5)

A coupler-in-developer type color developer with a following composition is prepared wherein the illustrated coupler [26] is added after dissolving in methanol.

| | |
|---|---|
| N,N-diethyl-2-methyl-p-phenylene-diamine | 2.0 g |
| Sodium sulfite anhydride | 2.0 g |
| Sodium carbonate monohydrate | 20.0 g |
| Potassium bromide | 1.0 g |
| Illustrated coupler [26] | 2.0 g |
| Add water to make 1 l | |

The sample obtained by coating high sensitive silver iodobromide emulsion (containing 6 mol% of silver iodide) onto polyethyleneterephthalate film with subbing, was exposed in the same manner as mentioned Example 1 and then is developed for 3 minutes at 24° C. with the aforesaid coupler-in-developer type color developer.

After the development, processes of washing for 4 minutes, bleaching for 5 minutes, washing for 5 minutes, fixing for 5 minutes, washing for 30 minutes and drying were given in consecutive order in an ordinary method and as a result thereof, a cyan image with an excellent spectral absorption characteristic with an absorption maximum of 666 nm and other excellent photographic characteristics was obtained.

What we claim is:

1. A method for forming a cyan dye image by developing an exposed silver halide photographic material with a developer containing a color developing agent in the presence of a cyan coupler, wherein the cyan coupler is a 2,5-di-acylaminophenol in which each of acylamino group has a substituent containing an oxycarbonyl, sulfonyloxy, oxysulfonyl, arylsulfonamide or arylsulfamoyl group or other organic group containing a sulfone group.

2. A method according to claim 1 wherein the cyan coupler is represented by the following formula:

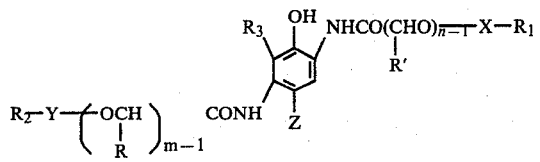

in which R and R' each represent a hydrogen atom or an alkyl group having 1 to 20 carbon atoms; $R_1$ and $R_2$ each represent a hydrogen atom or an oxycarbonyl, sulfonyloxy, oxysulfonyl, arylsulfonamide, arylsulfamoyl group, or an univalent organic group having a sulfone group; $R_3$ represents a hydrogen or halogen atom; X and Y each represent an alkylene or arylene group; Z represents a hydrogen atom or a split-off radical; and n and m each have a value of an integer of 1 or 2; provided that $R_1$ and $R_2$ are not hydrogen atom simultaneously.

3. A method according to claim 2 wherein $R_3$ represents a hydrogen atom.

4. A method according to claim 2 wherein $R_3$ represents a chlorine atom.

5. A method according to claim 2 wherein Z represents a split-off radical.

6. A method according to claim 5 wherein the split-off radical is a halogen atom or an aryloxy, carbamoyloxy, carbonylmethoxy, acyloxy, alkyloxy or sulfonamide group.

7. A method according to claim 6 wherein the split-off group is a chlorine atom.

8. A method according to claim 2 wherein X and Y each represents a tert-butylene, phenylene or a naphthalene group.

9. A method according to claim 1 wherein the developer contains no benzyl alcohol.

10. A photographic material having a silver halide emulsion layer coated on a support which layer comprising a cyan coupler of a 2,5-diacylaminophenol in which each of acylamino group has a substituent containing an oxycarbonyl, sulfonyloxy, oxysulfonyl, arylsulfonamide or arylsulfamoyl group or other organic group containing a sulfone group.

11. A photographic material according to claim 10 wherein the cyan coupler is represented by the following formula:

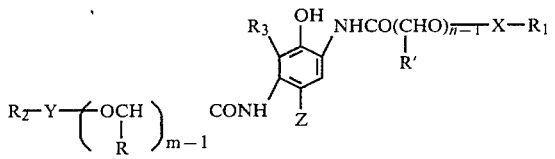

in which R and R′ each represent a hydrogen atom or an alkyl group having 1 to 20 carbon atoms; $R_1$ and $R_2$ each represent a hydrogen atom or an oxycarbonyl, sulfonyloxy, oxysulfonyl, arylsulfonamide, arylsulfamoyl group, or an univalent organic group having a sulfone group; $R_3$ represents a hydrogen or halogen atom; X and Y each represent an alkylene or arylene group; Z represents a hydrogen atom or a split-off radical; and n and m each have a value of an integer of 1 or 2; provided that $R_1$ and $R_2$ are not hydrogen atom simultaneously.

12. A photographic material according to claim 11 wherein $R_3$ represents a hydrogen atom.

13. A photographic material according to claim 11 wherein $R_3$ represents a chlorine atom.

14. A photographic material according to claim 11 wherein Z represents a split-off radical.

15. A photographic material according to claim 14 wherein the split-off radical is a halogen atom or an aryloxy, carbamoyloxy, carbonylmethoxy, acyloxy, alkyloxy or sulfonamide group.

16. A photographic material according to claim 15 wherein the split-off group is a chlorine atom.

17. A photographic material according to claim 11 wherein X and Y each represents a tert-butylene, phenylene or a naphthalene group.

* * * * *